US006823536B2

(12) United States Patent
Yip

(10) Patent No.: US 6,823,536 B2
(45) Date of Patent: Nov. 30, 2004

(54) SHOWERHEAD WITH REMOVABLE ELECTRONIC MEDIA DEVICE

(75) Inventor: Rudolph Chi Wai Yip, New Territories (HK)

(73) Assignee: Jing Mei Industrial Holdings Limited (CK)

( * ) Notice: Subject to any disclaimer, the term of this patent is extended or adjusted under 35 U.S.C. 154(b) by 0 days.

(21) Appl. No.: 10/278,266

(22) Filed: Oct. 23, 2002

(65) Prior Publication Data

US 2004/0078891 A1 Apr. 29, 2004

(51) Int. Cl.[7] ..... A47K 3/022

(52) U.S. Cl. ..... 4/615; 4/567; 239/72; 137/551

(58) Field of Search ..... 4/615, 567, 559, 4/605, 661; 239/72, 289, 449, 71; 137/551

(56) References Cited

U.S. PATENT DOCUMENTS 5,140,254 A * 8/1992 Katzman ..... 322/35
5,482,078 A * 1/1996 Yeh ..... 137/551
5,499,767 A * 3/1996 Morand ..... 239/383
6,182,910 B1 * 2/2001 Huen ..... 239/289
2003/0211838 A1 * 11/2003 Wageneck ..... 455/344

FOREIGN PATENT DOCUMENTS

EP 0418156 A1 * 3/1991

* cited by examiner

*Primary Examiner*—Gregory L. Huson
*Assistant Examiner*—Huyen Le
(74) *Attorney, Agent, or Firm*—Wolf, Greenfield & Sacks, P.C.

(57) ABSTRACT

A combination showerhead and electronic media device is provided. The electronic media device is integrated within the housing of the showerhead, thus saving space within the shower. The electronic media device may also be easily removed from the showerhead. In one embodiment, the electronic media device stores digital audio data, such as MP3 formatted audio data, and includes an interface for connecting the electronic media device to an external source, allowing audio data to be loaded into the electronic media device from the external source.

33 Claims, 7 Drawing Sheets

SHOWERHEAD WITH REMOVABLE ELECTRONIC MEDIA DEVICE

FIELD OF THE INVENTION

The present invention is related to the field of water-resistant electronic devices and, more particularly, to electronic media devices integrated with a showerhead.

BACKGROUND OF THE INVENTION

Many people enjoy some type of entertainment while taking a shower or bath. For example, bath toys, such as rubber ducks, or toy boats have been used in the bath for many years. Advances in technology have allowed the use of electronic devices in the shower. For example water resistant radios and compact disk players exist, which allow people to listen to music and/or radio stations in the shower or bath. Other devices, such as telephones have also been adapted for use in the shower or bath. Such devices can be mounted in the shower in various ways. One common way is to use suction cups or brackets to mount the device to the shower wall. Suction cups are disadvantageous because they are not reliable, especially when supporting heavy equipment. Brackets may require drilling into tile or shower walls, which can cause damage and leave unsightly holes if the brackets are ever removed. Another way of mounting the devices is to use a strap to hang the device over the showerhead. This method is also disadvantageous because it cannot be used with hand held showerheads. Additionally, all of these methods of mounting the device are disadvantageous because they consume space within the shower itself. Often, particularly with small showers, it is difficult to find space to mount an audio device because of space consumed by wall mounted shelves or shelves hung from the showerhead for holding shampoos, soaps, or other bath products. Space becomes particularly important when multiple people are sharing one shower. Alternatively, the device may be placed on a wall of the bathtub or placed outside of the shower or bath area itself, for example on a bathroom counter or floor. Placing the device outside of the shower precludes a person from operating the device without leaving the shower and may be difficult to see or hear over noise generated by water flowing from the shower or bath.

Additionally, some devices include built-in memory for storing multimedia data. This memory can be reprogrammed and updated with new data from an external source. In this case, it may be necessary to remove the device from the shower in order to update the memory. Thus, it is important to have a device which may be easily removed from the shower. Devices that are bracketed to the wall may be difficult to remove and replace.

Thus, an electronic device is needed for use in the shower which reduces the space consumed, can be mounted securely, and is easily removed and replaced in the shower.

SUMMARY OF THE INVENTION

The present invention includes an electronic media device removably integrated with a showerhead.

One object of this invention is to provide an electronic media device which conserves space in a shower or bath.

Another object of this invention is to provide an electronic media device which is easily mountable and removable in a shower or bath.

In accordance with one embodiment of the invention, a housing is provided which is closed at one end and includes inner and outer walls which define a first chamber between them. The first chamber is open in a direction away from the closed end of the housing. A second chamber is defined by the inner wall and an electronic media device is seated in the second chamber.

In one aspect of this embodiment, the housing includes a handle with a duct communicating with the first chamber for delivering water into the first chamber.

In another aspect of this embodiment, a ring carrying an array of nozzles having discharge ends extending away from the closed end of the housing and having inlet ends communicating with the first chamber is seated in the first chamber. In yet another aspect of this embodiment, a faceplate having a front wall and inner and outer walls that engage the inner and outer walls of the housing is provided. The front wall has a plurality of openings through which the discharge ends of the nozzles extend. The faceplate helps retain the nozzle ring on the housing.

In another embodiment, a housing is provided which is closed at one end and includes inner and outer walls which define a first chamber between them. The first chamber is open in a direction away from the closed end of the housing. A second chamber in the housing is defined by the inner wall of the housing. A faceplate is also provided which has an inner wall, an outer wall, a back wall connected to the inner wall, and a front wall connected to the inner and outer walls on a side opposite to the back wall. The inner and outer walls of the faceplate define a third chamber between them and the inner and back wall of the faceplate define a fourth chamber in the second chamber of the housing. An electronic media device is seated in the fourth chamber.

In one aspect of the invention, the electronic media device includes a non-volatile memory unit for storing audio data and an inner face for transferring the audio data between the memory unit and a device external to the electronic media device.

In another aspect of the invention, the electronic media device is mounted in the inner chamber by a bayonet type connection.

In yet another aspect of the invention, electronic media device threads into the chamber.

These and other objects and features of the present invention will be better understood and appreciated from a reading of the following detailed description with reference to the accompanying drawings.

DETAILED DESCRIPTION

Figure 1:
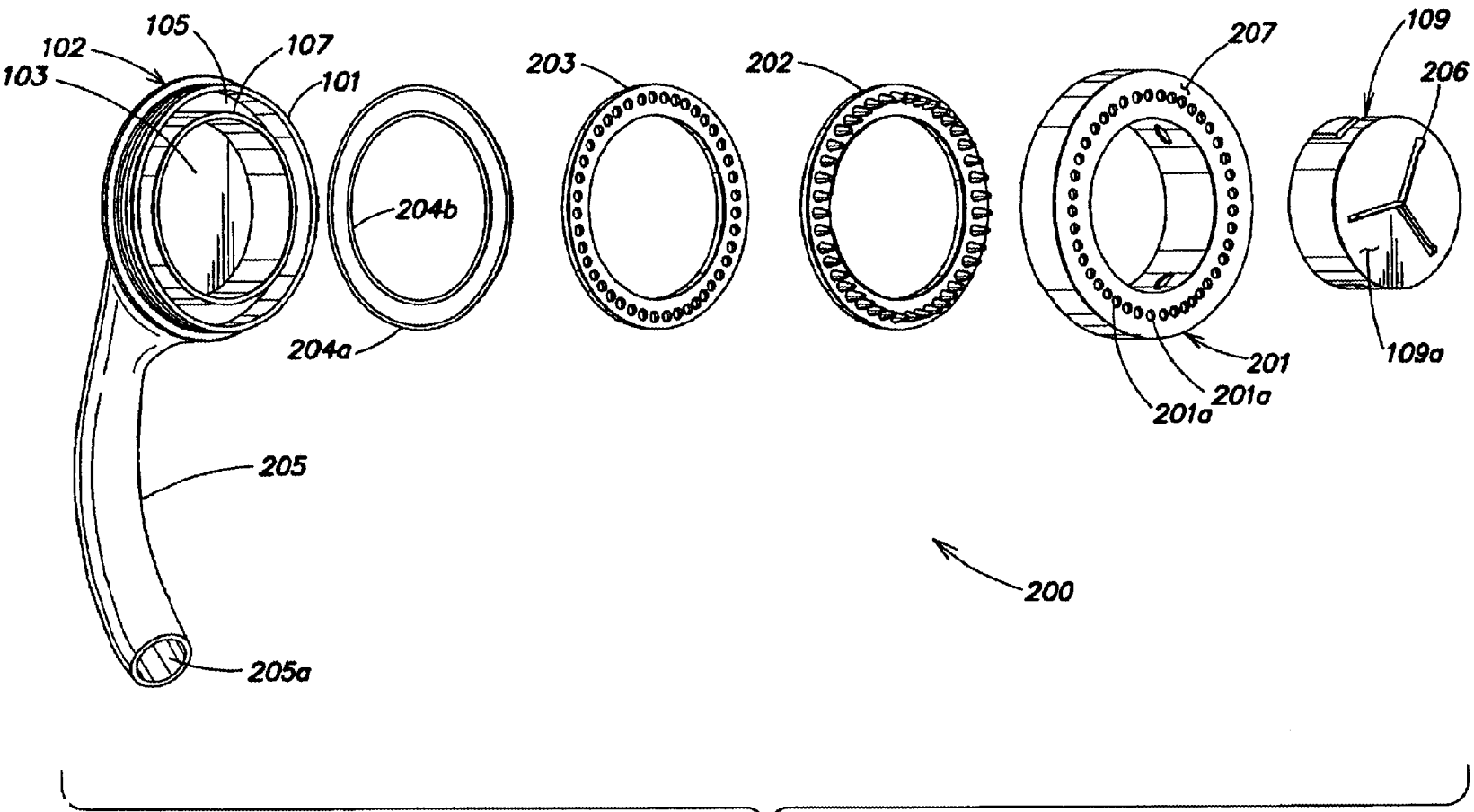
FIG. 1 is an exploded perspective view of one embodiment of the invention.
Figure 2:
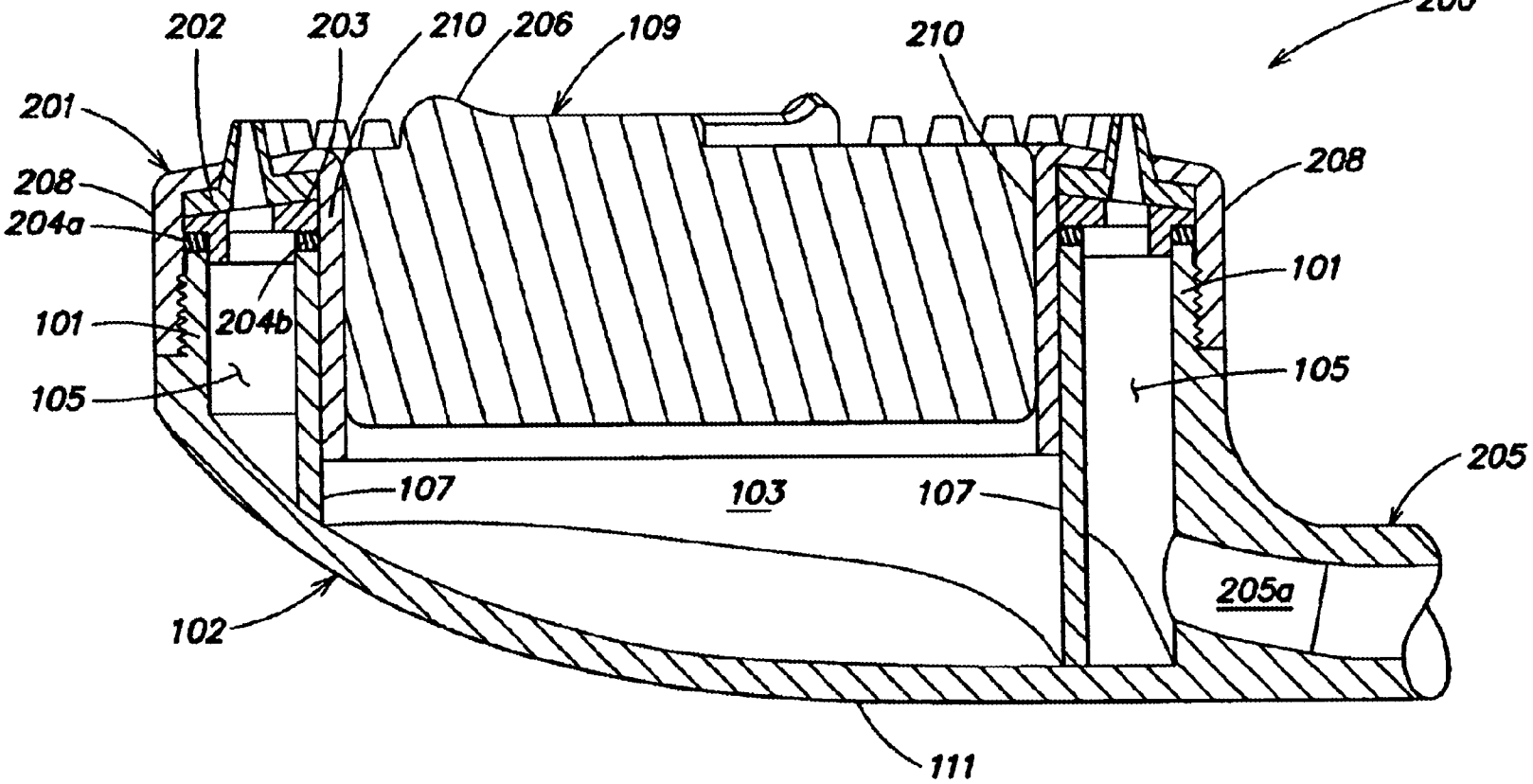
FIG. 2 is a cross-sectional view of the embodiment of FIG. 2A.

A combination showerhead and electronic media device 200 is shown in FIGS. 1 and 2. The apparatus includes a housing 102 having an outer wall 101 and an inner wall 107. The showerhead housing may be, for example, a handheld housing or a wall mounted showerhead housing. The inner and outer walls of the housing define a chamber 105 which is open in one direction and closed off in the other direction by the closed end 111 of housing 102. A second chamber 103 is defined by the inner wall 107 of the housing. An electronic media device 109 is seated in chamber 103.

In one embodiment, a handle 205 may be provided and connected to housing 102. Handle 205 may include a duct 205*a* for delivering water into chamber 105. Duct 205*a* may be connected to flexible hose (not shown) which carries water from a water pipe or other water source into the duct. A nozzle ring 202 is provided which may be seated in chamber 105. Nozzle ring 202 carries an array of nozzles which protrude out in the direction of the open end of the showerhead housing for discharging water in the chamber. Optionally, a spacer ring 203 which carries a plurality of holes, may be seated below nozzle ring 202 in chamber 105 to help prevent nozzle ring 202 from twisting.

faceplate 201 which attaches to the housing is shown. Faceplate 201 includes a front wall 207 having a plurality of openings 201*a* through which the nozzles of nozzle ring 202 extend and deliver water from the showerhead. As shown in FIG. 2, faceplate 201 may also include an outer wall 208 and an inner wall 210. The outer wall 101 of the showerhead housing 102 and the outer wall 208 of faceplate 201 may be threaded to allow faceplate 201 to screw onto the housing. Inner wall 210 of faceplate 201 may be seated inside chamber 103 parallel to inner wall 107 of the showerhead housing. O-rings 204*a* and 204*b*, shown in FIGS. 1 and 2, may be provided to seal housing 102. O-ring 204*a* may be seated on top of outer wall 101 to prevent water in chamber 105 from leaking outside the housing, and O-ring 204*b* may be seated on inner wall 107 to prevent water in chamber 105 from leaking into chamber 103.

Electronic media device 109 may be seated in chamber 103 inside inner wall 210 of faceplate 201. The front wall 109*a* of electronic media device 109 may be substantially even with the front wall 207 of faceplate 201, but may include a grip 206 which protrudes outward from the front surface of electronic media device 109 and the front wall of faceplate 201. Grip 206 allows a user to easily remove electronic media device 109 from chamber 103. In this embodiment, grip 206 allows a user to twist the electronic media device. However, the type of grip may vary depending on how the electronic media device is attached to the showerhead. For example, a tab could be used to pull the electronic media device out, or a lever could be used to disengage the electronic media device from the showerhead. Alternatively, the front wall 109*a* of electronic media device 109 may extend outward past the front wall 207 of faceplate 201 to allow a user to grip the sides of electronic media device 109.

Figure 3A:
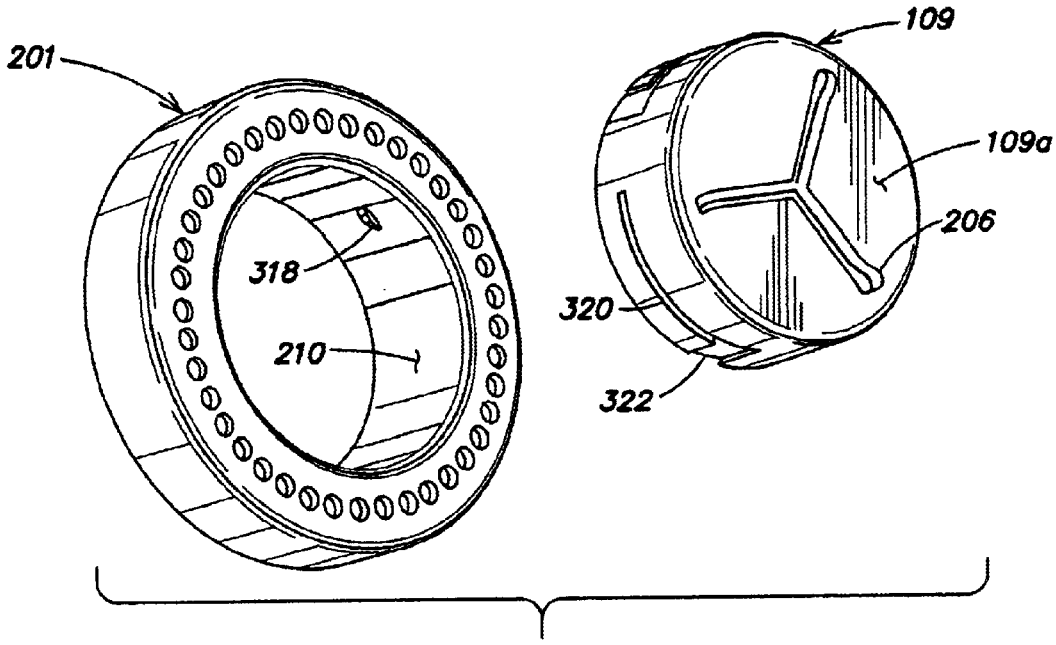
FIG. 3A is an exploded perspective view of the embodiment of FIG. 2A and showing an example of a mechanism for retaining an electronic media device in a showerhead in accordance with this invention.
Figure 3B:
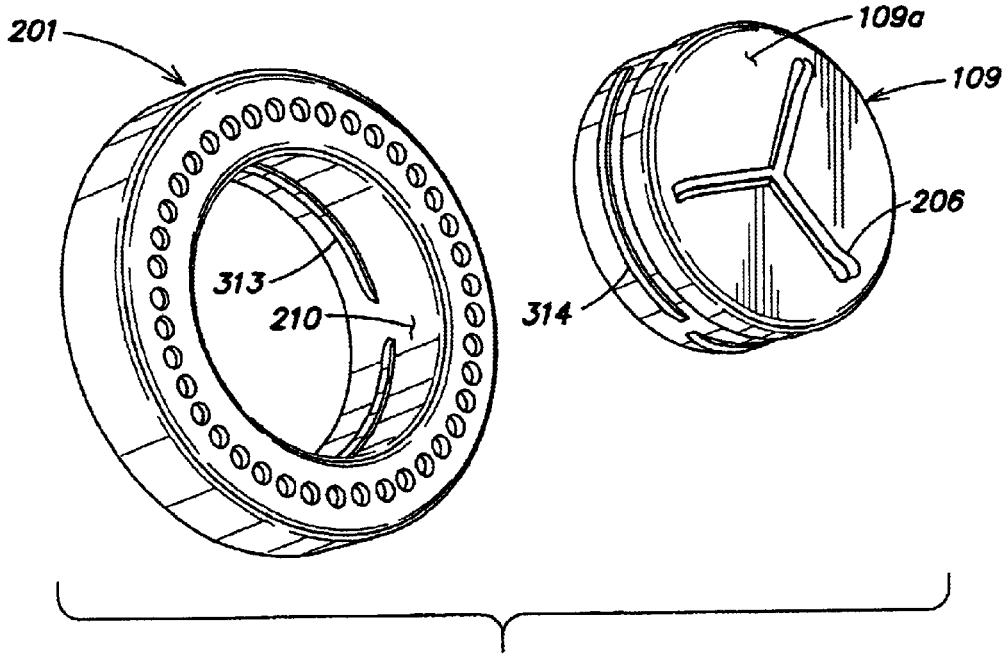
FIG. 3B is a view similar to FIG. 3A and showing another example of a mechanism for retaining an electronic media device in a showerhead in accordance with this invention.

FIGS. 3A and 3B are examples of how electronic media device 109 may be retained in the showerhead. As shown in FIG. 3A, in one embodiment, a bayonet-type connection is used. Inner wall 210 of faceplate 201 may include projections 318 which protrude inwardly from the inner side of inner wall 210. The outer wall of electronic media device 109 may include grooves 320 with inlet openings 322. The projections 318 may enter the circumferential part of grooves 320 through the axial inlet openings 322. When the electronic media device is twisted, projections 318 retain electronic media device 109 within the wall 210 of the faceplate. In another embodiment shown in FIG. 3B, the inner wall 210 of faceplate 201 carries threads 313 and the outer wall of electronic media device 109 is also threaded as shown at 314. Thus, electronic media device 109 may be screwed into the inner wall 210 of faceplate 201. It should be noted that the embodiments shown in FIGS. 3A and 3B are given only as examples. Numerous other ways of retaining an electronic media device inside a showerhead will occur readily to one skilled in the art and are intended to be within the spirit and scope of the invention. For example, a bolt or screw could be used to retain the electronic media device. Alternatively, a friction fit may be used.

Figure 4A:
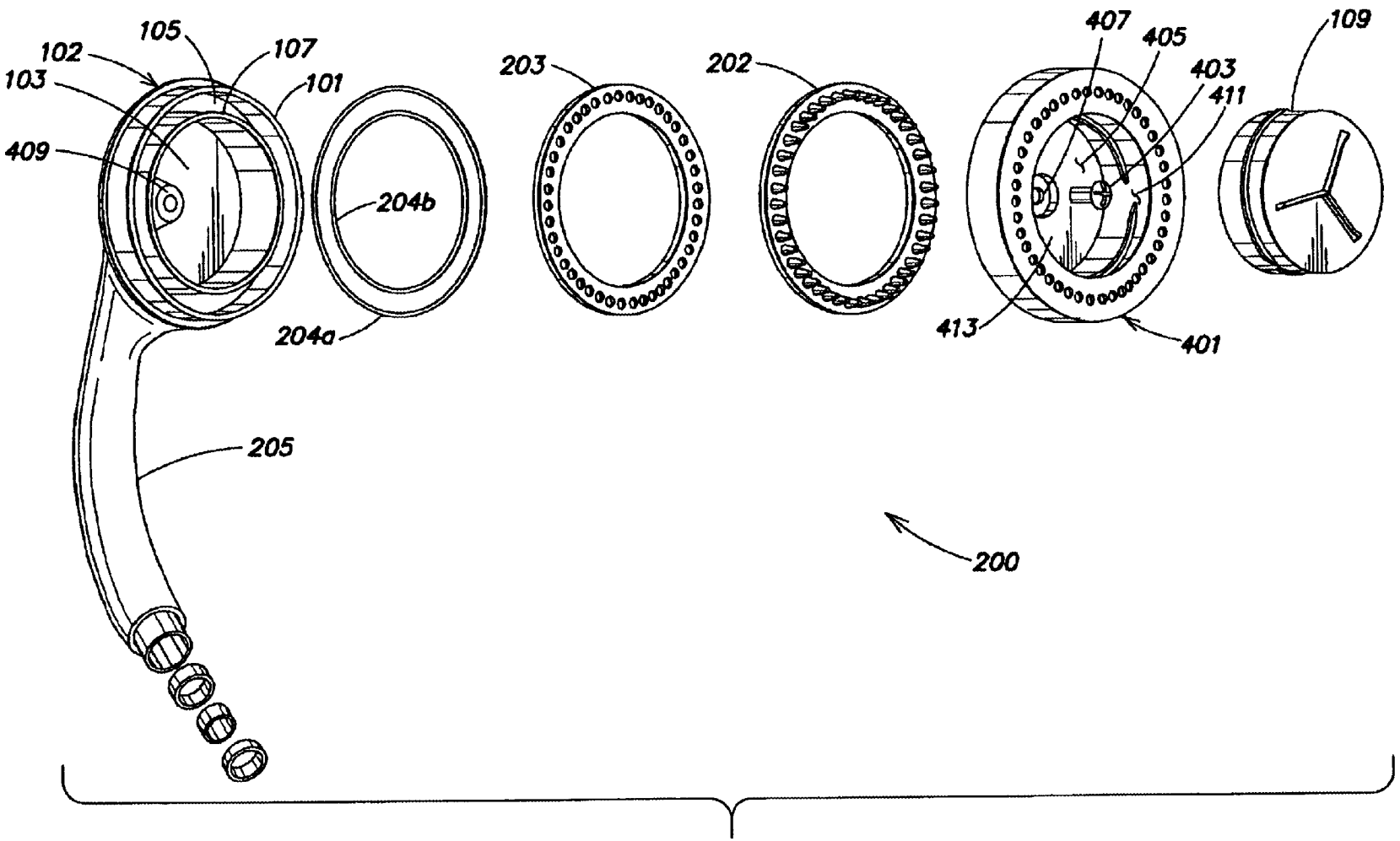
FIG. 4A is an exploded perspective view of another embodiment of the invention.
Figure 4B:
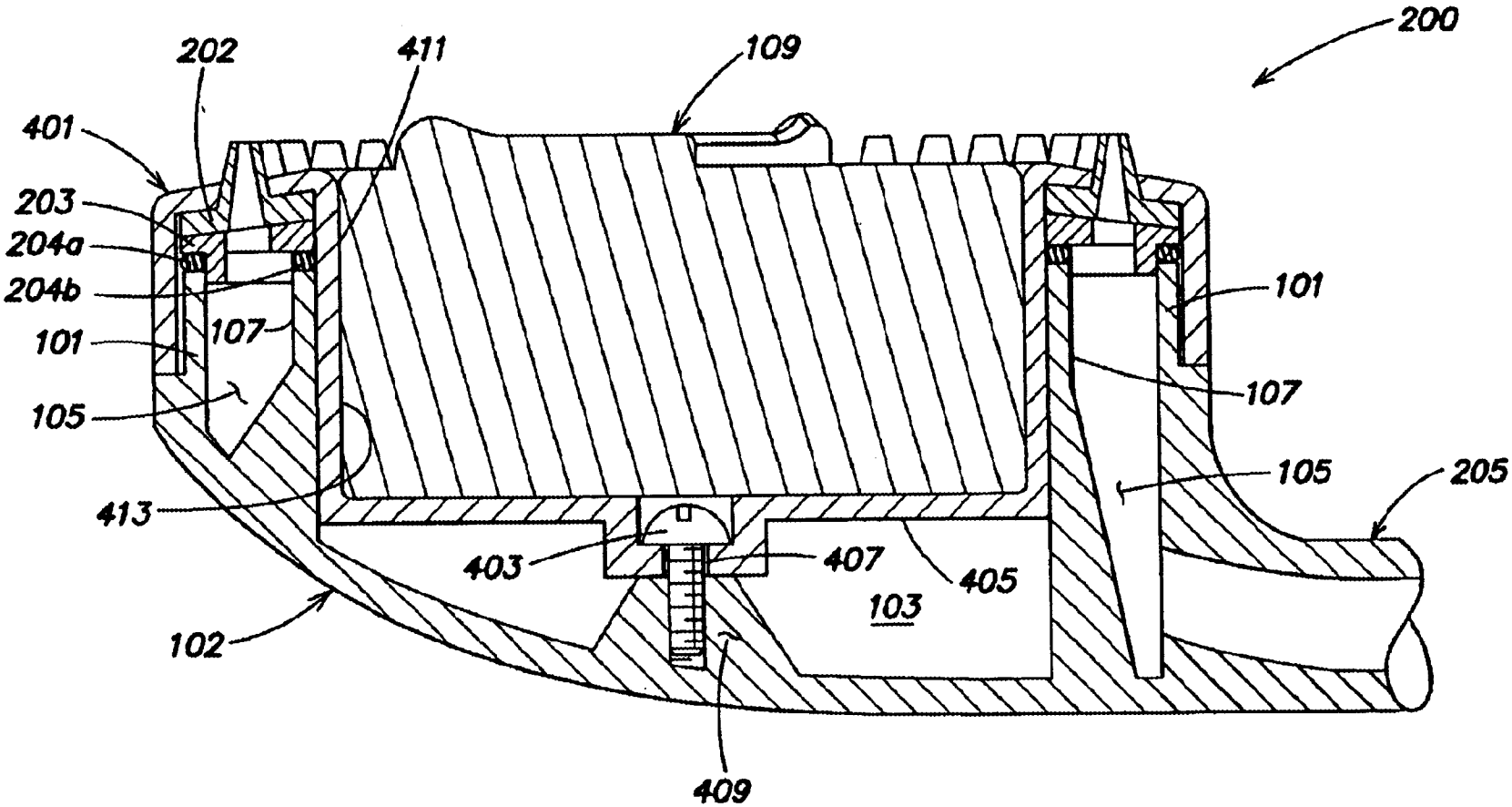
FIG. 4B is a cross-sectional view of the embodiment of FIG. 4A.

Another embodiment of the invention is shown in FIGS. 4A and 4B. Corresponding parts in the embodiment of FIGS. 1 and 2 and 4A and 4B are similarly numbered. A faceplate 401 is provided which attaches to the showerhead housing 102 formed in a well located at the center of the back wall. Faceplate 401, in this embodiment, includes a back wall 405 having a hole 407. The showerhead housing 102 includes a receptacle 409 in rear wall of chamber 103. A screw 403 extends into receptacle 409 through hole 407 in faceplate rear wall 405 to attach faceplate 401 to showerhead housing 102. The well houses the head of screw 403. The back wall 405 and inner wall 411 of faceplate 401 define another chamber 413 within chamber 103 of the showerhead housing. Electronic media device 109 is disposed in the chamber 413, and may be retained in the faceplate by, for example, the connections illustrated in FIGS. 3A and 3B.

Electronic media device 109 may be a device such as a radio or other audio device, a television, a telephone, wireless network component, etc. Because electronic media device 109 is embedded in the showerhead housing, the device should be water resistant. Additionally, electronic media device 109 may be subject to high temperatures due to hot water flowing through the showerhead. Thus, electronic media device 109 may be insulated to prevent damage to the electronic components of the device.

In one embodiment, electronic media device 109 stores compressed digital audio data. The compressed digital audio data may be stored in a format such as MPEG layer III (MP3), MPEG-1, MPEG-2, Windows Wave Format (WAV), Audio Interchange File Format (AIFF), or any other digital audio format. Electronic media device 109 may decompress the digital audio data and convert the data to an analog audio signal. The analog audio signal may then be played through a speaker built into the electronic media device 109. The digital audio data may be stored in a non-volatile memory of electronic media device 109. The memory may be an erasable programmable read only memory (EPROM), an electrically erasable programmable read only memory (EEPROM), such as a flash memory, or a ferroelectric random access memory (FRAM). Audio data may be loaded into the memory of electronic media device 109 from an external data source. The external data source may be, for example, a general purpose computer, a computer network connection, or another electronic media device.

Figure 5:
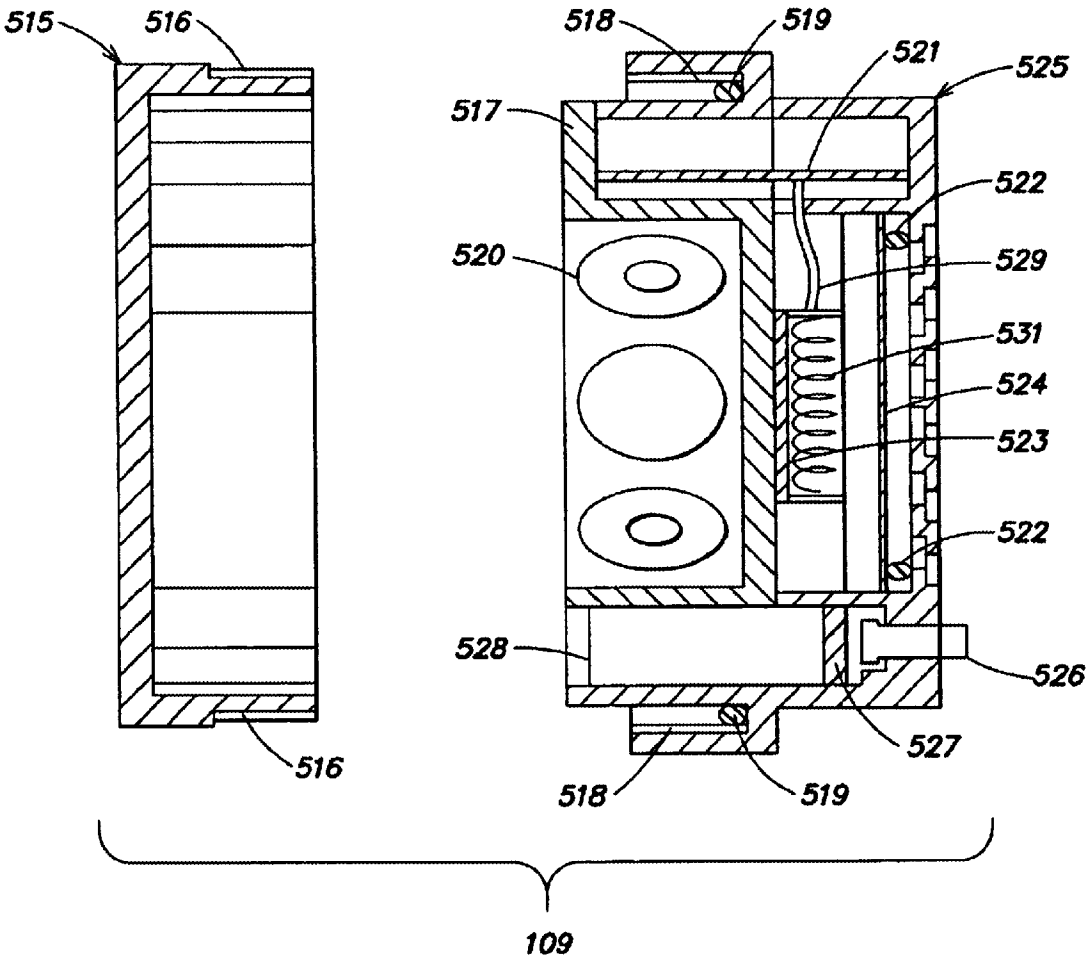
FIG. 5 is a partially exploded cross-sectional view of an embodiment of an electronic media device in accordance with this invention.

An embodiment of electronic media device 109 is shown in FIG. 5. The embodiment shown in FIG. 5 illustrates a device which is capable of playing stored digital audio data. It should be understood that the invention is not limited to such a device and any type of electronic media device may be used. For example, a radio, telephone, or television may be used.

Figure 6:
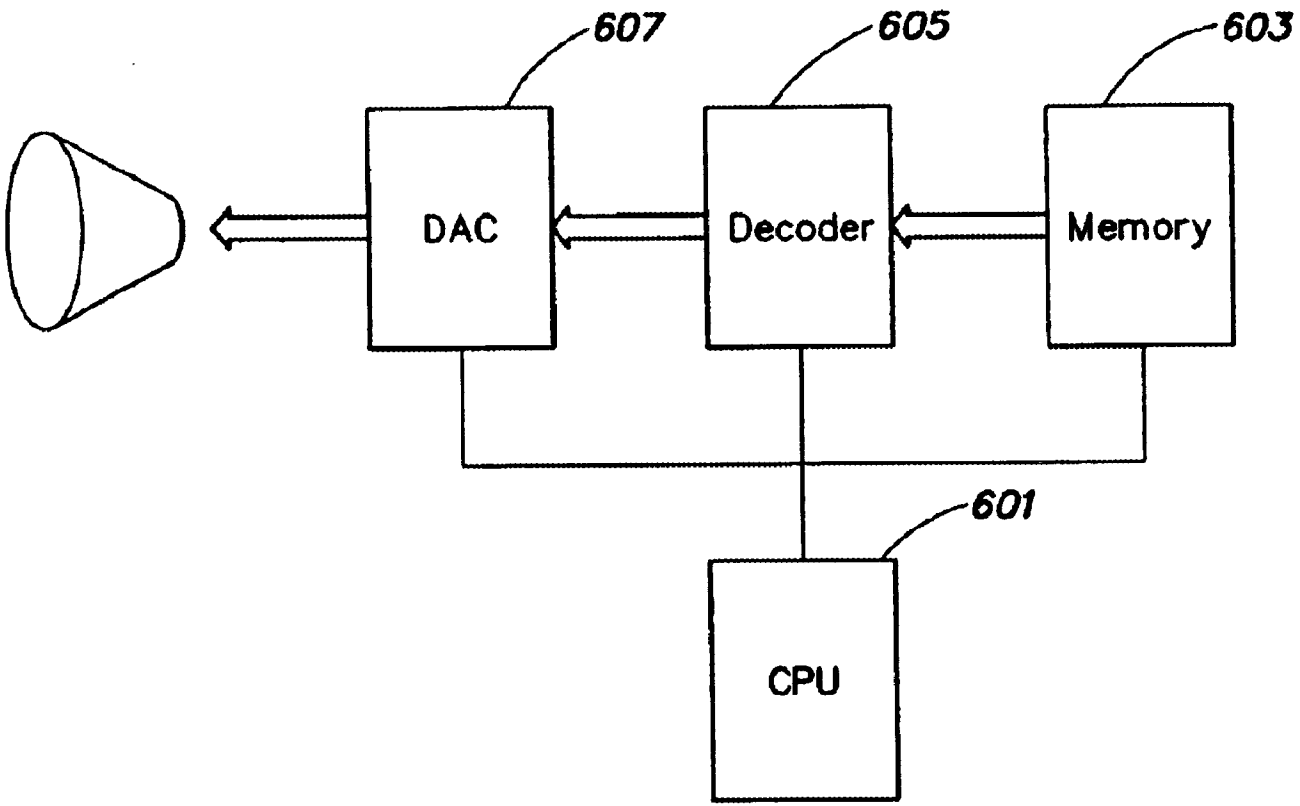
FIG. 6 is a block diagram of the circuitry of an embodiment of an electronic media device.

As shown in FIG. 5, Electronic media device 109 comprises a back cover 515 and a front cover 525. The back and front covers 515 and 525 carry threads 516 and 518 to screw the two together. An O-ring 519 is shown at the interface of the front and back covers to prevent water leakage inside the electronic media device. A replaceable battery 520 may be disposed within the front cover 525 of electronic media device 109 to supply power to the electronic components of the device. Electronic media device 109 also includes a printed circuit board (PCB) 521 having circuitry for storage and playback of music. The operation of PCB 521 is illustrated generally by the block diagram shown in FIG. 6. In one embodiment, PCB 521 includes CPU 601 which controls operation of components 603, 605, 607. CPU 601 executes program instructions which control operation of electronic media device 109. These instructions may be located in memory 603, in another memory unit on PCB 521, such as a ROM (not shown), or in an internal memory of CPU 601 (not shown). CPU 601 causes the transfer of digital audio data stored in memory 603 to decoder 605. If the digital audio data is not in a compressed format, decoder 605 may not be needed. Decoder 605 decompresses digital audio data, which is then transferred to digital to analog converter 607. Digital to analog converter 607 converts the digital data to an analog audio signal which is then supplied to a speaker. Printed circuit board 521 may also optionally include an amplifier (not shown) to increase the volume of the audio signal. Other configurations of circuitry for playing digital audio data will occur readily to one skilled in the art and are intended to be within the spirit and scope of the invention.

Referring to FIG. 5, electronic media device 109 further includes a speaker with a mylar diaphragm 524 in order to help prevent leakage of water into electronic media device 109. The speaker includes a magnet and coil 531 and is driven by an audio signal received from PCB 527 through connecting wire 529. Another O-ring 522 is shown behind the front wall of electronic media device 109. O-ring 522 further helps prevent leakage of water through diaphragm 524. The front cover 525 of electronic media device 109 may include a plurality of holes through which sound passes. The electronic media device may further include an on/off button 526 for activating and deactivating the device. The on/off button may protrude from the front cover 525 so as to be easily accessible when the device is embedded in the showerhead housing. On/off button 526 may be made of a water resistant material such as rubber to help prevent water from leaking into the interior of the electronic media device 109. On/off button 526 may be electrically connected to PCB 527. When on/off button 526 is pressed down in contact with PCB 527, a circuit is completed between PCB 527 and PCB 521, allowing power from battery 520 to reach PCB 521 and power the circuitry thereon.

The electronic media device may further comprise an interface to connect with an external device for transferring digital audio data. One end of a cable may be coupled with interface 528 and the other end may be coupled to an external media device. The interface 528 may be a serial interface, such as a Universal Serial Bus (USB) interface, or a parallel interface such as a Small Computer System Interface (SCSI). These interfaces are given only as examples and it should be understood that any type of data transfer interface may be used.

Because numerous modifications may be made of the invention, it is not intended that the breadth of the invention be limited to the specific embodiments illustrated and described. Rather, the scope of the invention is to be limited only by the appended claims and their equivalents.

What is claimed is:

1. A combination showerhead and electronic media device comprising:

a housing closed at one end including inner and outer walls defining a first chamber between them, the first chamber being open in a first direction away from the closed end of the housing and being adapted to receive water in a second direction, different from the first direction, and to discharge water in the first direction;

a second chamber in the housing defined, at least in part, by the inner wall of the housing; and an electronic media device in the second chamber.

2. The combination showerhead and electronic media device of claim 1, further comprising:

a handle with a duct communicating with the first chamber for delivering water into the first chamber.

3. The combination showerhead and electronic media device of claim 1, further comprising:

a ring seated in the first chamber, the ring carrying an array of nozzles having discharge ends extending away from the closed end of the housing and having inlet ends communicating with the chamber.

4. The combination showerhead and electronic media device of claim 3, further comprising:

a faceplate having a front wall and inner and outer walls that engage the inner and outer walls of the housing, the front wall having a plurality of openings through which the discharge ends of the nozzles extend, the faceplate retaining the ring on the housing.

5. The combination showerhead and electronic media device of claim 4, wherein the outer wall of the housing and the outer wall of the faceplate are threaded for joining the faceplate to the housing.

6. The combination showerhead and electronic media device of claim 4, further comprising a first gasket seated on the outer wall of the housing for sealing the outer chamber from outside of the housing and a second gasket seated on the inner wall of the housing for sealing the inner chamber from the outer chamber.

7. The combination showerhead and electronic media device of claim 1, wherein the inner wall of the housing has threads on an inner side of the inner wall and the audio device includes an outer casing, the outer casing having threads on an outer side of the casing for engaging the threads on the inner wall of the housing for removably retaining the device in the second chamber.

8. The combination showerhead and electronic media device of claim 1, wherein the inner wall of the housing includes projections protruding from an inner side of the inner wall and the audio device includes an outer casing, the outer casing having grooves on an outer side of the casing for engaging the projections on the inner wall of the housing for removably retaining the device in the second chamber.

9. The combination showerhead and electronic media device of claim 1, wherein the electronic media device further comprises a front cover having an internal thread and a back cover having an external thread, the external thread connecting the back cover to the front cover by engaging the internal thread of the front cover.

10. The combination showerhead and audio device of claim 9, further comprising a switching device accessible on the front cover of the outer casing for activating and deactivating the electronic media device.

11. The combination showerhead and audio device of claim 1, wherein the electronic media device further comprises:

a non-volatile memory unit for storing audio data;

a speaker having a mylar diaphragm; and circuitry for reading the audio data from the memory unit and providing an audio signal to the speaker based on the audio data from the memory unit.

12. The combination showerhead and electronic media device of claim 11, where in the electronic media device further comprises:

an interface for transferring the audio data between the memory unit and a device external to the electronic media device.

13. The combination showerhead and electronic media device of claim 12, wherein the audio data is digital audio data and the circuitry for reading further comprises:

a decoder for decompressing the digital audio data; and an analog to digital converter for converting the decompressed digital audio data to an analog audio signal and providing the analog audio signal to the speaker.

14. A combination showerhead and electronic media device comprising:

a housing closed at one end including inner and outer walls defining a first chamber between them, the first chamber being open in a direction away from the closed end of the housing;

a second chamber in the housing defined, at least in part, by the inner wall of the housing;

a faceplate having an inner wall, an outer wall, a back wall connected to the inner wall, and a front wall connected to the inner and outer walls on a side opposite to the back wall, the inner and outer walls of the faceplace defining a third chamber between them, and the inner wall of the faceplate and back wall defining, at least in part, a fourth chamber, in the second chamber of the housing; and an electronic media device seated in the fourth chamber.

15. The combination showerhead and audio device of claim 14, further comprising:

a handle with a duct communicating with the first chamber for delivering water into the first chamber.

16. The combination showerhead and audio device of claim 14, further comprising:

a nozzle ring seated in the first chamber, the nozzle ring carrying an array of nozzles having discharge ends extending away from the closed end of the housing and having inlet ends communicating with the first chamber.

17. The combination showerhead and electronic media device of claim 16, wherein the front wall of the faceplate has a plurality of openings through which the discharge ends of the nozzles extend, the faceplate retaining the nozzle ring on the housing.

18. The combination showerhead and electronic media device of claim 17, wherein the closed end of the housing includes a receptacle and the back wall of the faceplate includes a hole in the back wall and a fastener engaging the receptacle through the hole in the back wall.

19. The combination showerhead and electronic media device of claim 17, further comprising a first gasket seated engaging the outer wall of the housing and a second gasket engaging the inner wall of the housing for sealing the first and second chambers.

20. The combination showerhead and electronic media device of claim 14, wherein the inner wall of the faceplate is threaded and the audio device includes an outer casing, the outer casing having threads on an outer side of the casing for engaging the threads on the inner wall of the faceplate.

21. The combination showerhead and electronic media device of claim 14, wherein a bayonet connection removably joins the inner wall of the faceplate to the audio device.

22. The combination showerhead and electronic media device of claim 14, wherein the electronic media device further comprises:

a non-volatile memory unit for storing audio data;

a speaker having a diaphragm; and circuitry for reading the audio data from the memory unit and providing an audio signal to the speaker based on the audio data from the memory unit.

23. The combination showerhead and electronic media device of claim 22, wherein the electronic media device further comprises:

an interface for transferring audio data between the memory unit and a device external to the audio device.

24. The combination showerhead and electronic media device of claim 23, wherein the audio data is digital audio data and the circuitry for reading further comprises:

a decoder for decompressing the digital audio data; and an analog to digital converter for converting the decompressed digital audio data to an analog audio signal and providing the analog audio signal to the speaker.

25. The combination showerhead and electronic media device of claim 14, further comprising a control switch on the audio device and accessible from the side of the housing away from the closed end for activating and deactivating the device.

26. A combination showerhead and electronic media device comprising:

a housing having an inner chamber and an outer chamber surrounding the inner chamber, an inlet duct connected to the outer chamber for directing shower water to said outer chamber;

an array of outlet openings in the outer chamber for discharging the shower water in a spray from the housing; and an electronic media device in the inner chamber.

27. A combination showerhead and electronic media device as described in claim 26 wherein the array of openings in the outer chamber surround the electronic media device and discharge the shower water in a first direction, and said audio device has a front cover through which sound is emitted from the device.

28. A combination showerhead and electronic media device as described in claim 26 wherein the electronic media device is removably mounted in the inner chamber.

29. A combination showerhead and electronic media device as described in claim 28 wherein the electronic media device has an on/off control accessible when the device is in the inner chamber.

30. A combination showerhead and electronic media device as described in claim 28 wherein the electronic media device is mounted in the inner chamber by a bayonnet-type connection.

31. A combination showerhead and electronic media device as described in claim 28 wherein the audio device threads into the inner chamber.

32. A combination showerhead and electronic media device as described in claim 26 wherein the inlet duct comprises a handle for the showerhead.

33. A combination showerhead and electronic media device as described in claim 26 wherein the array of openings comprise a plurality of nozzles mounted on the housing.

* * * * *